United States Patent [19]

Baumgarth

[11] Patent Number: 4,998,386

[45] Date of Patent: Mar. 12, 1991

[54] ANTI-CLOG CAPS FOR RAIN GUTTERS AND THE LIKE

[76] Inventor: Arnold E. Baumgarth, 15 Judy Ct., Centerport, N.Y. 11721

[21] Appl. No.: 512,888

[22] Filed: Apr. 23, 1990

[51] Int. Cl.[5] ..... E04D 13/06

[52] U.S. Cl. ..... 52/16; 52/11

[58] Field of Search ..... 52/16, 15, 11, 12

[56] References Cited

U.S. PATENT DOCUMENTS 4,142,370 3/1979 Giordano ..... 52/11

4,253,281 3/1981 Ruttenberg ..... 52/12

FOREIGN PATENT DOCUMENTS 765992 8/1967 Canada ..... 52/16

*Primary Examiner*—Michael Safavi

*Attorney, Agent, or Firm*—Richard L. Miller

[57] ABSTRACT

An end overflow apparatus for a rain gutter is provided and consists of a structure at the end of the rain gutter for allowing rain water to overflow the end of the rain gutter when both the rain gutter and the leader are clogged with debris caused by a downpour of the rain water that is too much for the clogged rain gutter and the leader to normally handle.

2 Claims, 1 Drawing Sheet

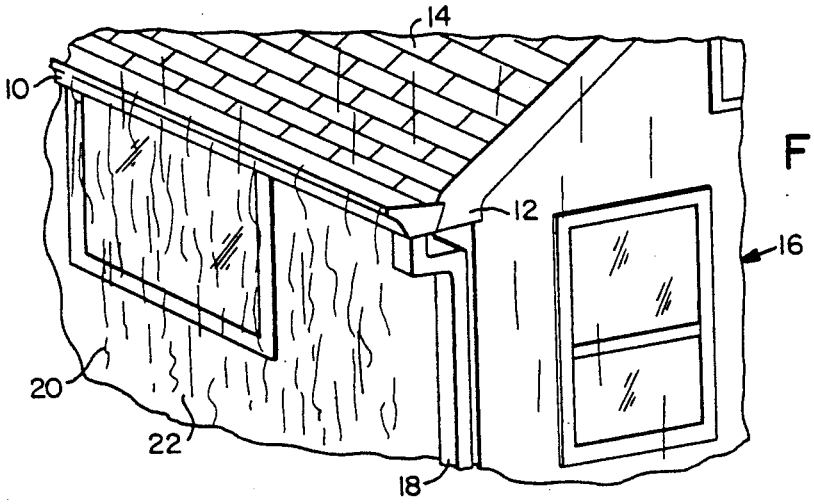
FIG. 1
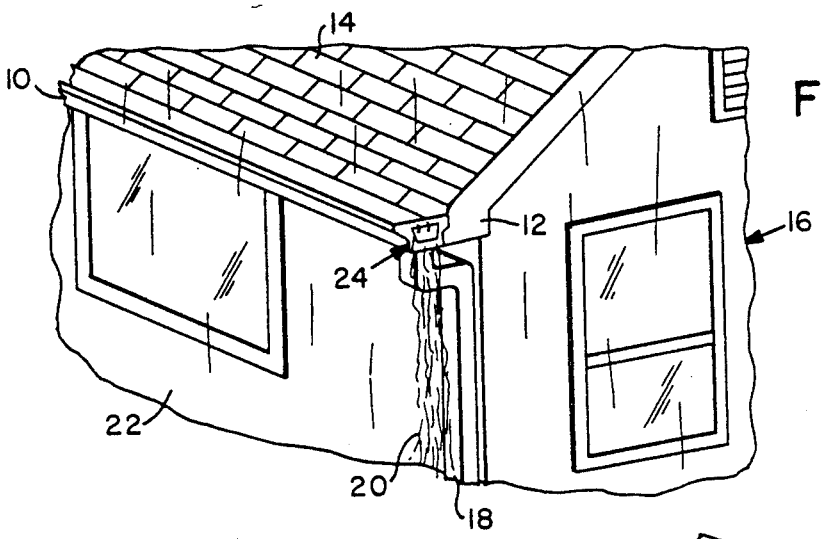
FIG. 2
FIG. 4
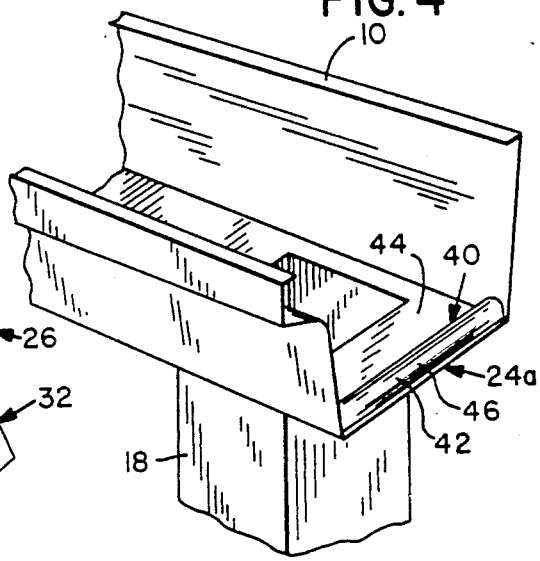
FIG. 3
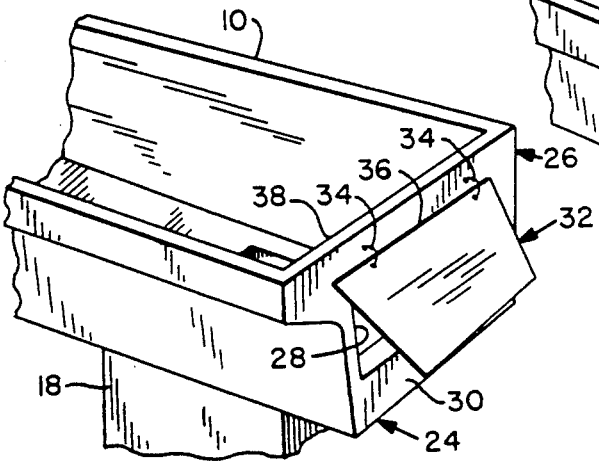

ANTI-CLOG CAPS FOR RAIN GUTTERS AND THE LIKE

BACKGROUND OF THE INVENTION

The instant invention relates generally to rain gutters and more specifically it relates to an end overflow apparatus for a rain gutter when the rain gutter is clogged Numerous rain gutters have been provided in the prior art that are adapted to include structures for facilitating the cleaning of debris out of the rain gutters. For example U.S. Pat. Nos. 4,142,370 to Giordano; 4,407,097 to Allen and 4,669,232 to Wyatt all are illustrative of such prior art. While these units may be suitable for the particular purpose to which they address, they would not be as suitable for the purpose of the present invention as hereafter described.

SUMMARY OF THE INVENTION

A primary object of the present invention is to provide an end overflow apparatus for a rain gutter that will overcome the shortcomings of the prior art devices.

Another object is to provide an end overflow apparatus for a rain gutter that will allow rain water to exit the end of the rain gutter when both rain gutter and the leader are clogged with debris.

An additional object is to provide an end overflow apparatus for a rain gutter being in one instance a swivel door in an end cap and in another instance a raised saddle member in place of the end cap so that the rain water can exit there over when a downpour of rain is too much for the clogged rain gutter and the leader to handle.

A further object is to provide an end overflow that is simple and easy to use.

A still further object is to provide an end overflow apparatus for a rain gutter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative, only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view of a house with a typical prior art rain gutter system overflowing;

FIG. 2 is a similar view but with the instant invention installed thereon;

FIG. 3 is a diagrammatic enlarged perspective view of a first embodiment of the instant invention; and FIG. 4 is a diagrammatic enlarged perspective view similar to FIG. 3, but of a second embodiment of the instant invention.

DETAILED DESCRIPTION OF THE PREFERRED EMBODIMENTS

Turning now descriptively to the drawings, in which similar reference characters denote similar elements throughout the several views, FIG. 1 shows a standard rain gutter 10 being of a straight length formed for mounting along and under the overhang 12 of a roof 14 of a building 16 such as a house. The rain gutter 10 cooperates with a leader 18 attached thereto. If the rain gutter 10 and leader 18 are clogged with leaves and other debris the rain water 20 will overflow the rain gutter 10 along the side 22 of the building 16 and can enter basement window wells and stair wells leading to the basement entrance.

FIG. 2 shows an end overflow apparatus 24 for allowing the rain water 22 to overflow the end of the rain gutter 10 when both the rain gutter 10 and the leader 18 are clogged with debris whereby a downpour of the rain water 20 is too much for the clogged rain gutter 10 and the leader 18 to normally handle.

As best seen in FIG. 3, the overflow apparatus 24 includes an end cap 26 mounted on the end of the rain gutter 10 near the attachment of the leaded 18. The end cap 26 has an aperture 28 therethrough to provide a raised bottom portion 30 on the end cap 26.

A door 32 is sized to fit over and cover the aperture 28 in the end cap 26. A pair of hinges 34 are spaced apart and connected between the top edge 36 of the door 32 and a top portion 38 of the end cap 26 over the aperture 28. The door 32 can swivel open to allow the rain water 20 to overflow the raised bottom portion 30 for exiting therefrom when the rain gutter 10 and the leader 18 are clogged.

FIG. 4 shows another embodiment of anti-clog apparatus **24*a* in which the end cap is eliminated and a raised saddle member 40 is substituted in its place at the end of the rain gutter 10 near the attachment of the leader 18 so that the rain water 20 can overflow the raised saddle member 40 for exiting therefrom when the rain gutter 10 and the leader 18** are clogged.

The raised saddle member 40 can be a crimp 42 formed across the bottom wall 44 of the rain gutter 10 at the end thereof, in which the crimp 42 will be slightly higher than the bottom wall 44. The raised saddle member 40 can also be a bead of caulking 46 across the bottom wall 44. The raised saddle member 40 can also be a bead of caulking 46 across the bottom wall 44 of the rain gutter 10 at the end thereof, in which the bead of caulking 46 will be slightly higher than the bottom wall 44.

When the overflow apparatus 24 or **24*a* is in place on the end of the rain gutter 10 and the rain gutter and leader 18 are not clogged with debris the rain water 20 will flow normally therethrough. If the rain gutter 10 and the leader 18 are clogged with debris the rising rain water 20 in the rain gutter 10 will overflow at the end instead of along the side of the building 16**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An end overflow apparatus for a rain gutter being of a straight length formed for mounting along and under the overhang of a roof of a building and cooperating with a leader attached thereto, said apparatus comprising means for allowing rain water to overflow the end of the rain gutter when both the rain gutter and the leader are clogged with debris whereby a downpour of rain water is too much for the clogged rain gutter and the leader to normally handle wherein said means includes:

(a) an end cap mounted on the end of the rain gutter near the attachment of the leader, said end cap having an aperture therethrough to provide a raised bottom portion on said end cap;

(b) a door sized to fit over and cover the aperture in said end cap; and (c) a hinge means connected between the top edge of said door and a top portion of said end cap over the aperture so that said door can swivel open to allow the rain water to overflow the raised bottom portion for exiting therefrom when the rain gutter and the leader are clogged.

2. An end overflow apparatus for a rain gutter being of a straight length formed for mounting along and under the overhang of a roof of a building and cooperating with a leader attached thereto, said apparatus comprising means for allowing rain water to overflow the end of the rain gutter when both the rain gutter and the leader are clogged with debris whereby a downpour of rain water is too much for the clogged rain gutter and the leader to normally handle, wherein said means includes a raised saddle member at the end of the rain gutter near the attachment of the leader so that the rain water can overflow said raised saddle member for exiting therefrom when the rain gutter and the leader are clogged wherein said raised saddle member is a bead of caulking attached across the bottom wall of the rain gutter at the end thereof, said bead of caulking being slightly higher than the bottom wall.

* * * * *